US009556383B2

(12) United States Patent
Soto et al.

(10) Patent No.: US 9,556,383 B2
(45) Date of Patent: Jan. 31, 2017

(54) ASPHALT OXIDATION TECHNIQUE

(71) Applicants: Nicholas Soto, Waxahachie, TX (US); Dale Kelley, Flower Mound, TX (US); Paul Richardson, Euless, TX (US); Daniel Boss, Parker, TX (US)

(72) Inventors: Nicholas Soto, Waxahachie, TX (US); Dale Kelley, Flower Mound, TX (US); Paul Richardson, Euless, TX (US); Daniel Boss, Parker, TX (US)

(73) Assignee: Building Materials Investment Corporation, Wilmington, DE (US)

( * ) Notice: Subject to any disclaimer, the term of this patent is extended or adjusted under 35 U.S.C. 154(b) by 229 days.

(21) Appl. No.: 14/209,456

(22) Filed: Mar. 13, 2014

(65) Prior Publication Data

US 2014/0262935 A1 Sep. 18, 2014

Related U.S. Application Data

(60) Provisional application No. 61/792,963, filed on Mar. 15, 2013.

(51) Int. Cl.

| | |
|---|---|
| ***C10C 3/04*** | (2006.01) |
| *C10C 3/00* | (2006.01) |
| *C10C 3/02* | (2006.01) |

(52) U.S. Cl.

CPC ..... *C10C 3/04* (2013.01)

(58) Field of Classification Search

CPC ..... C10C 3/00; C10C 3/002; C10C 3/02; C10C 3/04

See application file for complete search history.

(56) References Cited

U.S. PATENT DOCUMENTS

| | | | | |
|---|---|---|---|---|
| 1,782,186 | A | 11/1930 | Abson | |
| 2,179,208 | A | 11/1939 | Burk et al. | |
| 2,200,914 | A | 5/1940 | Burk et al. | |
| 2,375,117 | A | 5/1945 | Lentz | |
| 2,450,756 | A | 10/1948 | Hoiberg | |
| 2,762,755 | A | 9/1956 | Kinnaird, Jr. | |
| 3,126,329 | A | 3/1964 | Fort | |
| 4,338,137 | A | 7/1982 | Goodrich | |
| 4,584,023 | A | 4/1986 | Goodrich | |
| 7,901,563 | B2 | 3/2011 | Ruan et al. | |
| 2007/0131578 | A1* | 6/2007 | Ruan | C08L 95/00 208/6 |
| 2009/0312872 | A1* | 12/2009 | Burris | C10C 3/04 700/265 |
| 2012/0132565 | A1* | 5/2012 | Aldous | B01F 5/0413 208/22 |

* cited by examiner

*Primary Examiner* — Brian McCaig
(74) *Attorney, Agent, or Firm* — Alvin T. Rockhill

(57) ABSTRACT

The present invention relates to a method for oxidizing asphalt which comprises dispersing an oxygen containing gas throughout an asphalt flux in an oxidation zone while the asphalt flux is maintained at a temperature which is within the range of about 400° F. to 550° F., wherein the oxygen containing gas is introduced into the oxidation zone through a recycle loop. The recycle loop pumps asphalt flux from the oxidation zone and reintroduces the asphalt flux into the oxidation zone as oxygen enhanced asphalt flux. The recycle loop will typically include a pump which pulls the asphalt flux from the oxidation zone and which pumps the oxygen enhanced asphalt flux into the oxidation zone, and wherein the oxygen containing gas is injected into the recycle loop at a point before the asphalt flux enters into the pump.

14 Claims, 1 Drawing Sheet

ASPHALT OXIDATION TECHNIQUE

This application claims the benefit of U.S. Provisional Patent Application Ser. No. 61/792,963, filed on Mar. 15, 2013. The teachings of U.S. Provisional Patent Application Ser. No. 61/792,963 are incorporated by reference herein in their entirety.

TECHNICAL FIELD

This invention relates to a technique for oxidizing asphalt that is particularly useful in preparing industrial asphalt compositions.

BACKGROUND OF THE INVENTION

Asphalt offers outstanding binding and waterproofing characteristics. These physical attributes of asphalt have led to its widespread utilization in paving, roofing, and waterproofing applications. For instance, asphalt is used in manufacturing roofing shingles because it has the ability to bind sand, aggregate, and fillers to the roofing shingle while simultaneously providing excellent water barrier characteristics.

Naturally occurring asphalts have been used in various applications for hundreds of years. However, today almost all of the asphalt used in industrial applications is recovered from the refining of petroleum. Asphalt, or asphalt flux is essentially the residue that remains after gasoline, kerosene, diesel fuel, jet fuel, and other hydrocarbon fractions have been removed during the refining of crude oil. In other words, asphalt flux is the last cut from the crude oil refining process.

To meet performance standards and product specifications, asphalt flux that is recovered from refining operations is normally treated or processed to attain desired physical characteristics and to attain uniformity. For instance, asphalt that is employed in manufacturing roofing products has to be treated to meet the special requirements demanded in roofing applications. More specifically, in the roofing industry it is important to prevent asphaltic materials from flowing under conditions of high temperature such as those encountered during hot summers. In other words, the asphaltic materials used in roofing products should maintain a certain level of stiffness (hardness) at high temperatures. This increased level of stiffness is characterized by a reduced penetration, an increased viscosity, and an increased softening point.

To attain the required level of stiffness and increased softening point that is demanded in roofing applications the asphalt flux is typically oxidized. This is typically done via an air blowing process. In such air blowing techniques, an oxygen containing gas, such as air, is blown through the asphalt flux for a period of about 2 to about 8 hours while it is maintained at an elevated temperature which is typically within the range of 400° F. (204° C.) to 550° F. (288° C.). The air blowing process results in the stiffness and the softening point of the asphalt flux being significantly increased. This is highly desirable because ASTM D 3462-96 (Standard Specification for Asphalt Shingles Made from Glass Felt and Surfaced with Mineral Granules) requires roofing asphalt to have a softening point which is within the range of 190° F. (88° C.) to 235° F. (113° C.) and for the asphalt to exhibit a penetration at 77° F. (25° C.) of above 15 dmm (1 dmm =0.1 mm). In fact, it is typically desirable for asphalt used in roofing applications to have a penetration which is within the range of 15 dmm to 35 dmm in addition to a softening point which is within the range of 185° F. (85° C.) to 235° F. (113° C.).

In typical air blowing techniques the oxygen containing gas is introduced and distributed into the bottom 14 of an un-agitated blow still 15 through spargers 16. Once the oxygen containing gas (air) is in the system it travels up through the asphalt 17 and ultimately reaches the surface of the asphalt 8 at the top of the blow still as illustrated in FIG. 1. As the air travel through the asphalt from the bottom to the top of the blow still it is available to react with the asphalt flux being oxidized. The rate of chemical reactions occurring within the blow still is known to be limited by the diffusion of oxygen in the air bubbles traveling through the system. It is also known that mechanical agitation has a significant effect on the oxidation processing time by increasing the surface area of the air bubbles in the system. In any case, conventional asphalt oxidation techniques are currently mass transfer limited.

Air blowing has been used to increase the softening point and stiffness of asphalt since the early part of the twentieth century. For example, U.S. Pat. No. 2,179,208 describes a process wherein asphalt is air blown at a temperature of 300° F. (149° C.) to 500° F. (260° C.) in the absence of a catalyst for a period of 1 to 30 hours after which time a polymerization catalyst is added for an additional treatment period of 20 to 300 minutes at a temperature of 225° F. (107° C.) to 450° F. (232° C.). Over the years a wide variety of chemical agents have been used as air blowing catalysts. For instance, ferric chloride, $FeCl._3$ (see U.S. Pat. No. 1,782,186), phosphorous pentoxide, $P_2O_5$ (see U.S. Pat. No. 2,450,756), aluminum chloride, $AlCl_3$ (see U.S. Pat. No. 2,200,914), boric acid (see U.S. Pat. No. 2,375,117), ferrous chloride, $FeCl_2$, phosphoric acid, $H_3PO_4$ (see U.S. Pat. No. 4,338,137), copper sulfate CuSO, zinc chloride $ZnCl_2$, phosphorous sesquesulfide, $P_4S_3$, phosphorous pentasulfide, $P_2S_5$, and phytic acid, $C_6H_6O_6(H_2PO_3)_6$ (see U.S. Pat. No. 4,584,023) have all been identified as being useful as air blowing catalysts.

Several patents describe the application of phosphoric mineral acids in modifying asphalt properties. For instance, U.S. Pat. No. 2,450,756 describes a process to make oxidized asphalts by air blowing petroleum hydrocarbon in the presence of a phosphorus catalyst, including phosphorus pentoxide, phosphorus sulfide, and red phosphorus. U.S. Pat. No. 2,762,755 describes a process of air blow asphaltic material in the presence of a small amount of phosphoric acid. U.S. Pat. No. 3,126,329 discloses a method of making blown asphalt through air blowing in the presence of a catalyst which is an anhydrous solution of 50 weight percent to 80 weight percent phosphorus pentoxide in 50 weight percent to 20 weight percent phosphoric acid having the general formula $H_mR_nPO_4$.

All of the air blowing techniques described in the prior art share the common characteristic of both increasing the softening point and decreasing the penetration value of the asphalt flux treated. In other words, as the asphalt flux is air blown, its softening point increases and its penetration value decreases over the duration of the air blowing procedure. It has been the conventional practice to air blow asphalt flux for a period of time that is sufficient to attain the desired softening point and penetration value. However, in the case of some asphalt fluxes, air blowing to the desired softening point using conventional procedures results in a penetration value which is too low to be suitable for utilization in roofing applications. These asphalt fluxes are called "hard asphalt fluxes". In other words, hard asphalt fluxes cannot be air blown using conventional procedures to a point where both the required softening point and penetration values are attained. Accordingly, today there is a need for a process that can be used to air blow hard asphalt flux to both a softening point which is within the range of 185° F. (85° C.) to 250° F. (121° C.) and a penetration value at 77° F. (25° C.) of above 15 dmm.

SUMMARY OF THE INVENTION

This invention is based on a unique method for distribution of an oxygen containing gas throughout the asphalt flux in an air blowing process. This technique utilizes a recycle loop on the blow still (the asphalt could either be pulled from the top or the bottom of the blow still tank and then returned to the opposite end of the tank). In the method of this invention a pump and air injection port are located on the recycle loop with the oxygen containing gas being added into the recycle loop just before the pump. The oxygen containing gas replaces the gas that is sparged into the blow still. The pump generates small bubbles of the oxygen containing gas within the asphalt flux in the blow still and accordingly increases the surface area of the bubbles and in turn promotes a faster processing time. This is highly beneficial because faster processing times can be achieved which, of course, results in more efficient use of equipment, higher levels of productivity, lower energy requirements, and cost savings. In one embodiment of this invention, the process can be carried out to reduce the overall level of the oxygen containing gas needed to attain desired asphalt characteristics via the oxidation process. In this scenario the level of carry over blow loss (the amount of asphalt blown out of the blow still during the process) can be reduced. This is, of course, highly beneficial in that the yield of oxidized asphalt is increased leading to better efficiency and from an environmental standpoint. In other words, by utilizing the technique of this invention, the air blow time required to produce industrial asphalt for utilization in roofing applications can be reduced. Accordingly, utilizing the technique of this invention increases the capacity of air blowing units and also reduces the energy consumption required to produce industrial asphalt. Because the asphalt flux is air blown for shorter period of time the amount of blow loss (asphalt lost during the air blowing procedure) is reduced as is the amount of material emitted into the environment. Accordingly, the technique of this invention reduces the cost of raw materials and lessens the environmental impact of the air blowing procedure.

The subject invention more specifically discloses a method for oxidizing asphalt which comprises dispersing an oxygen containing gas throughout an asphalt flux in an oxidation zone while the asphalt flux is maintained at a temperature which is within the range of about 400° F. to 550° F., wherein the oxygen containing gas is introduced into the oxidation zone through a recycle loop. The recycle loop pumps asphalt flux from the oxidation zone and reintroduces the asphalt flux into the oxidation zone as oxygen enhanced asphalt flux. In this method the oxygen containing gas is injected into the recycle loop to produce an oxygen enhanced asphalt flux. The recycle loop will typically include a pump which pulls the asphalt flux from the oxidation zone and which pumps the oxygen enhanced asphalt flux into the oxidation zone, and wherein the oxygen containing gas is injected into the recycle loop at a point before the asphalt flux enters into the pump. In one embodiment of this invention the recycle loop will pump the asphalt flux from an area near the top the oxidation zone and pumps the oxygen enhanced asphalt flux into the oxidation zone at a point near the bottom of the oxidation zone.

DETAILED DESCRIPTION OF THE INVENTION

The process of this invention is particularly useful in treating hard asphalt flux to produce industrial asphalt that is useful in roofing applications. More specifically, hard asphalt flux can be treated by the process of this invention to produce industrial asphalt that has a softening point which is within the range of 185° F. (85° C.) to 250° F. (121° C.) and a penetration value of at least 15 dmm. In most cases, the industrial asphalt will have a penetration value which is within the range of 15 dmm to 35 dmm. Industrial asphalt that is made by the process of this invention for utilization in roofing applications will typically have a softening point which is within the range of 185° F. (85° C.) to 250° F. (121° C.) and a penetration value which is within the range of 15 dmm to 35 dmm. Industrial asphalt made by the process of this invention for roofing applications will preferably have a softening point which is within the range of 190° F. (88° C.) to 210° F. (99° C.) and a penetration value which is within the range of 15 dmm to 25 dmm.

The asphalt flux is normally the petroleum residue from a vacuum distillation column used in refining crude oil. The asphaltic material used as the starting material can also be solvent extracted asphalt, naturally occurring asphalt, or synthetic asphalt. Blends of such asphaltic materials can also be treated by the process of this invention. The asphalt flux can also include polymers, recycled tire rubber, recycled engine oil residue, recycled plastics, softeners, antifungal agents, biocides (algae inhibiting agents), and other additives. Tar and pitch can also be used as the starting material for treatment by the technique of this invention. The hard asphalt flux is characterized in that it cannot be air blown to attain both a softening point which is within the range of 185° F. (85° C.) to 250° F. (121° C.) and a penetration value of at least 15 dmm. However, it should be understood that the process of this invention is also applicable to the treatment of virtually any asphaltic materials in addition to hard asphalt flux. The technique of this invention is of particular value in the treatment of hard asphalt flux that is difficult or impossible to air blow utilizing standard air blowing methods into industrial asphalt having properties suitable for use in roofing applications.

Figure 3:
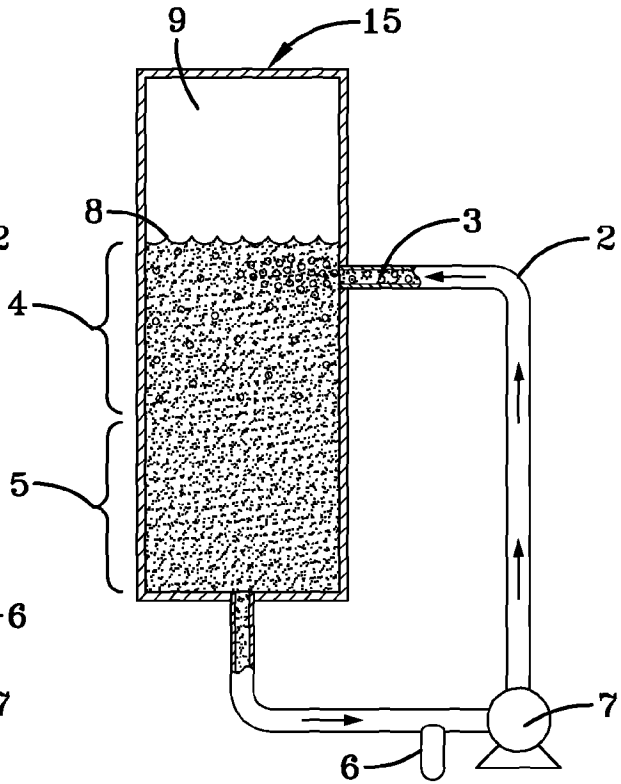
FIG. 3 is a schematic drawing which depicts another embodiment of this invention where a recycle loop introduces asphalt flux having an enhance oxygen level into a point near the top of the oxidization zone (blow still).
Figure 2:
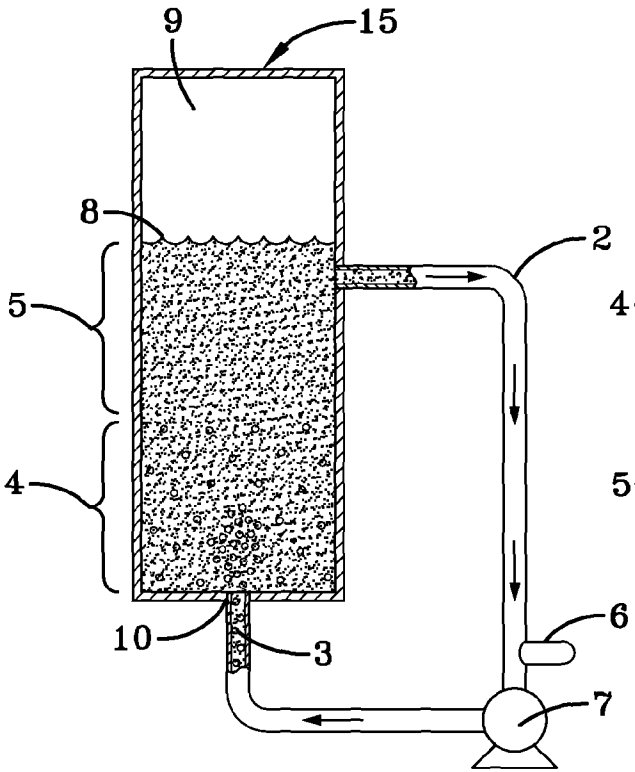
FIG. 2 is a schematic drawing which depicts one embodiment of this invention where a recycle loop introduces asphalt flux having an enhance oxygen level into the oxidation zone at the bottom the oxidization zone (blow still).
Figure 1:
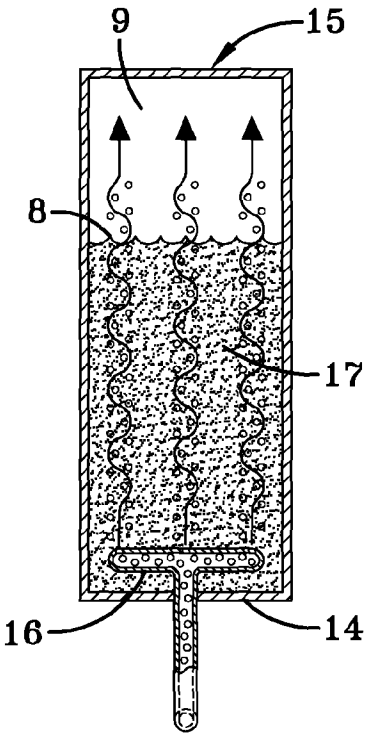
FIG. 1 is a schematic drawing which depicts a conventional technique for introducing air into a blow still for oxidizing asphalt flux via a sparger located near the bottom of the blow still.

In practicing the method of this invention, conventional asphalt oxidation techniques are employed with the exception of the oxygen containing gas is introduced into the oxidization zone (blow still) via a recycle loop. Two embodiments of this invention are depicted in FIG. 2 and FIG. 3. In the embodiment of the invention depicted in FIG.

2 a recycle loop 2 introduces asphalt flux having an enhanced oxygen level 3 into the oxidation zone 4 at the bottom the oxidization zone (blow still) 5. The oxygen containing gas is pumped into the recycle loop at an injection point 6 which is situated in the recycle loop 3 at a point before the asphalt flux flows through a pump 7 which circulates the asphalt flux through the recycle loop 3 from a point located near the top of the asphalt level 8 but which is below the dead space 9 above the top of the oxidization zone 5. In this embodiment of the invention the asphalt flux having an enhanced oxygen level is reintroduced into the bottom of the oxidization zone at an injection point 10. In the configuration illustrated in FIG. 2 the recycle loop pumps the asphalt flux from an area near the top the oxidation zone and pumps the oxygen enhanced asphalt flux into the oxidation zone at a point near the bottom of the oxidation zone. The area near the top of the oxidization zone is typically in the top 50% of the oxidation zone, is more typically in the top 30% of the oxidation zone, and is preferably in the top 10% of the oxidation. The area near the bottom of the oxidization zone is typically in the lower 50% of the oxidation zone, is more typically in the lower 20% of the oxidation zone, and is preferably in the lower 10% of the oxidation zone.

In the embodiment of the invention depicted in FIG. 3 a recycle loop 2 introduces asphalt flux having an enhanced oxygen level 3 into the oxidation zone 4 at a point which is near the top the asphalt level 8 in the oxidaization zone 4. The oxygen containing gas is pumped into the recycle loop at an injection point 6 which is situated in the recycle loop 3 at a point before the asphalt flux flows through a pump 7 which circulates the asphalt flux through the recycle loop 3 from a point located near the bottom of the oxidization zone 11 in this embodiment of the invention the asphalt flux having an enhanced oxygen level is reintroduced into the top of the oxidization zone 4 at an injection point 12 which is located near the top of the asphalt level 8 but below the dead space 9 above the top of the oxidization. In a further embodiment of this invention the asphalt flux having an enhanced oxygen content is reintroduced into the dead space 9 above the oxidization zone 4. This configuration is advantageous in that it minimizes the amount of blow loss experienced in oxidizing an asphalt flux to a desired level while maintaining acceptable rates of oxidization. This is highly desirable since it is more environmentally friendly then conventional air blowing techniques and in that it increases the amount of oxidized product which is attained from a given amount of starting material.

In the configuration illustrated in FIG. 3 the recycle loop pumps the asphalt flux from an area near the bottom the oxidation zone and pumps the oxygen enhanced asphalt flux into the oxidation zone at a point near the top of the oxidation zone. The area near the bottom of the oxidization zone is typically in the lower 50% of the oxidation zone, is more typically in the lower 30% of the oxidation zone, and is preferably in the lower 10% of the oxidation. The area near the top of the oxidization zone is typically in the upper 50% of the oxidation zone, is more typically in the upper 20% of the oxidation zone, and is preferably in the upper 10% of the oxidation zone.

In the technique of this invention, the asphalt flux is air blown by heating it to a temperature which is within the range of 400° F. (204° C.) to 550° F. (288° C.) and blowing an oxygen containing gas through it. This air blowing step will preferably be conducted at a temperature which is within the range of 425° F. (218° C.) to 525° F. (274° C.) and will most preferably be conducted at a temperature which is within the range of 450° F. (232° C.) to 500° F. (260° C.). This air blowing step will typically take about 2 hours to about 8 hours and will more typically take about 3 hours to about 6 hours. However, the air blowing step will be conducted for a period of time that is sufficient to attain the ultimate desired softening point. In other words, the asphalt flux will be air blown until a softening point of at least 100° F. (38° C.) is attained.

The oxygen containing gas (oxidizing gas) is typically air. The air can contain moisture and can optionally be enriched to contain a higher level of oxygen. Chlorine enriched air or pure oxygen can also be utilized in the air blowing step. Air blow can be performed either with or without a conventional air blowing catalyst. Some representative examples of air blowing catalysts include ferric chloride ($FeCl_3$), phosphorous pentoxide ($P_2O_5$), aluminum chloride ($AlCl_3$), boric acid ($H_3BO_3$), copper sulfate ($CuSO_4$), zinc chloride ($ZnCl_2$), phosphorous sesquesulfide ($P_45_3$), phosphorous pentasulfide ($P_25_5$), phytic acid ($C_6H_6[OPO\text{-}(OH)_2]_6$), and organic sulfonic acids. The asphalt oxidation of this invention can also be conducted in the presence of a polyphosphoric acid as described in U.S. Pat. No. 7,901,563. The teachings of U.S. Pat. No. 7,901,563 are incorporated by reference herein for the purpose of describing air blowing procedures which are conducted in the presence of a polyphosphoric acid.

The industrial asphalt made can be used in making roofing products and other industrial products using standard procedures. For instance, the industrial asphalt can be blended with fillers, stabilizers (like limestone, stonedust, sand, granule, etc.), polymers, recycled tire rubber, recycled engine oil residue, recycled plastics, softeners, antifungal agents, biocides (algae inhibiting agents), and other additives.

This invention is illustrated by the following examples that are merely for the purpose of illustration and are not to be regarded as limiting the scope of the invention or the manner in which it can be practiced. Unless specifically indicated otherwise, parts and percentages are given by weight.

EXAMPLE 1

The method of this invention can be conducted as depicted in FIG. 2 wherein hot asphalt flux is maintained in a blow still at a temperature which is within the range of about 400° F. to 550° F. In this method air is injected into a recycle loop which recycles asphalt flux which is being drawn from the blow still at a point near the top of the blow still and reintroduces it as oxygen enhanced asphalt flux at a point located at the bottom of the blow still. In this method, the asphalt flux is maintained in the blow still until it is oxidized to a level which is sufficient to attain desired physical characteristics, such as the desired softening point and penetration value.

EXAMPLE 2

In this experiment an asphalt flux was oxidized utilizing the method of this invention in a system of the type depicted in FIG. 2. The system was filled with approximately 6 gallons (about 20,000 grams) of asphalt flux having an initial softening point of about 92° F. Softening points were measured by the Mettler cup and ball method according to ASTM D3461 using a Mettler DP-70 tester. In this experiment oxygen was injected into the recycle loop at a rate of 3 standard cubic feet per minute (136 standard cubic feet per minute per ton of asphalt). This system consisted of a heated steel vessel having a diameter of 10.5 inches which was 25 inches tall. It had a band heater which was located at the bottom of the vessel to maintain a temperature within the range of 400° F. to 500° F. The heater was regulated by an external Watlow controller. The asphalt was pumped through the recycle loop with a Viking positive displacement pump which was operated at 431 rpm to attain a pumping rate of 6 gallons per minute.

During the oxidization process the softening point of the oxidized asphalt was monitored. The increase in softening point as a function of oxidization time is reported in Table 1.

TABLE 1

| Time | Softening Point |
|---|---|
| 0 minutes (initial) | 92° F. |
| 48 minutes | 105° F. |
| 60 minutes | 115° F. |
| 80 minutes | 125° F. |
| 95 minutes | 138° F. |
| 110 minutes | 155° F. |

As can be seen from Table 1, the technique of this invention proved to be successful in oxidizing the asphalt flux as exhibited by the increasing softening point of the asphalt over time. Accordingly, the technique of this invention can be used to replace conventional blow stills in air blowing asphalt flux to make industrial asphalt.

While certain representative embodiments and details have been shown for the purpose of illustrating the subject invention, it will be apparent to those skilled in this art that various changes and modifications can be made therein without departing from the scope of the subject invention.

What is claimed is:

1. A method for oxidizing asphalt which comprises dispersing an oxygen containing gas throughout an asphalt flux in an oxidation zone while the asphalt flux is maintained at a temperature which is within the range of about 400° F. to 550° F., wherein the oxygen containing gas is introduced into the oxidation zone through a recycle loop, wherein the recycle loop pumps asphalt flux from the oxidation zone and reintroduces the asphalt flux into the oxidation zone as an oxygen enhanced asphalt flux, wherein the recycle loop further includes a pump which pulls the asphalt flux from the oxidation zone and which pumps the oxygen enhanced asphalt flux into the oxidation zone, and wherein the oxygen containing gas is injected into the recycle loop at a point before the asphalt flux enters into the pump.

2. The method of claim 1 wherein an oxygen containing gas is injected into the recycle loop to produce the oxygen enhanced asphalt flux.

3. The method of claim 1 wherein the recycle loop pumps the asphalt flux from the oxidation zone and pumps the oxygen enhanced asphalt flux into the oxidation zone, and wherein the oxygen enhanced asphalt flux is pumped into the oxidation zone at a lower point in the oxidation zone than the point at which the asphalt flux is pumped from the oxidation zone.

4. The method of claim 3 wherein the oxygen containing gas is air.

5. The method of claim 4 wherein the air is enriched with oxygen.

6. The method of claim 1 wherein said method results in the production of industrial asphalt, wherein the industrial asphalt has a softening point which is within the range of 185° F. to 235° F., and wherein the industrial asphalt has a penetration value which is within the range of 15 dmm to 35 dmm.

7. The method of claim 1 wherein said method results in the production of industrial asphalt, wherein the industrial asphalt has a softening point which is within the range of 190° F. to 220° F., and wherein the industrial asphalt has a penetration value which is within the range of 15 dmm to 25 dmm.

8. The method of claim 1 wherein the asphalt flux is maintained at a temperature which is within the range of about 425° F. to about 525° F., and wherein the asphalt flux is maintained in the oxidation zone for a period of about 2 hours to about 8 hours.

9. The method of claim 8 wherein the asphalt flux is maintained in the oxidation zone for a period of about 3 hours to about 6 hours.

10. The method of claim 1 wherein the asphalt flux is maintained at a temperature which is within the range of about 450° F. to about 500° F., and wherein the asphalt flux is maintained in the oxidation zone for a period of about 3 hours to about 6 hours.

11. The method of claim 1 wherein the oxidation zone is a blow still.

12. The method of claim 1 wherein the oxidation is conducted in the presence of an air blowing catalyst.

13. The method of claim 1 wherein the oxygen enhanced asphalt flux is pumped into the oxidation zone at a higher point in the oxidation zone than the point at which the asphalt flux is pumped from the oxidation zone.

14. The method of claim 1 wherein said method is carried out as a batch process.

* * * * *